United States Patent [19]

Beretta et al.

[11] 4,199,312

[45] Apr. 22, 1980

[54] APPARATUS FOR BENDING CONCRETE CURBING

[75] Inventors: Angelo V. Beretta; David Beretta, both of Lincoln, R.I.

[73] Assignee: Durastone Co., Lincoln, R.I.

[21] Appl. No.: 891,129

[22] Filed: Mar. 27, 1978

[51] Int. Cl.[2] ..... B28B 11/00

[52] U.S. Cl. ..... 425/383; 264/295; 425/403

[58] Field of Search ..... 425/383, 403; 264/228, 264/295

[56] References Cited

U.S. PATENT DOCUMENTS

| | | | |
|---|---|---|---|
| 1,691,672 | 11/1928 | Riddell | 425/403 |
| 3,932,093 | 1/1976 | Maier | 425/403 |
| 3,941,545 | 3/1976 | Beretta et al. | 425/403 |
| 4,015,923 | 4/1977 | Järvinen et al. | 425/403 |

*Primary Examiner*—James H. Derrington
*Attorney, Agent, or Firm*—Salter & Michaelson

[57] ABSTRACT

Apparatus for initially bending pairs of spaced parallel concrete curbing immediately after it has been cast and while still in a zero slump state. The apparatus includes a blade-like tool adapted to extend into the V-shaped space which normally exists between opposed pairs of concrete curbing when the latter emerge from curb molding apparatus, said tool including opposed sidewalls which may be flexibly bent or distorted away from each other at pre-selected portions along the longitudinal extent of such tool so as to simultaneously and oppositely bend said curbing pair. Means for distorting the flexible sidewalls of the tool are provided in the form of rollers adapted to contact interior portions of the sidewalls and be forced downwardly with respect thereto, thereby increasing the distance between the sidewalls at such preselected locations.

10 Claims, 7 Drawing Figures

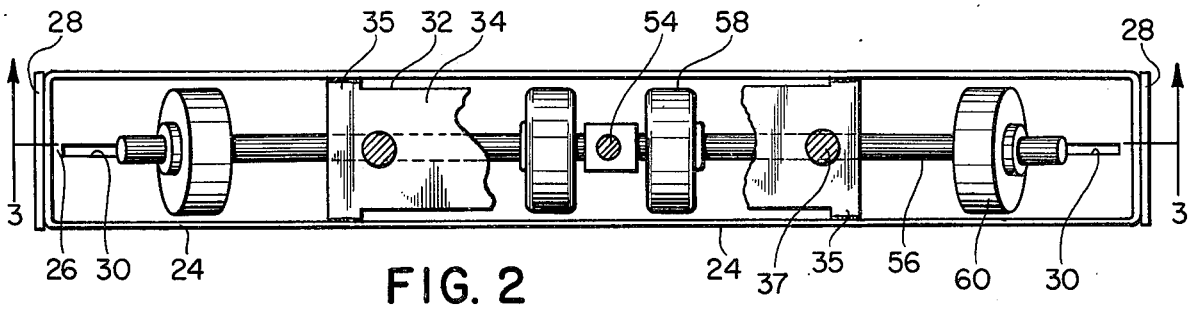
FIG. 2
FIG. 3
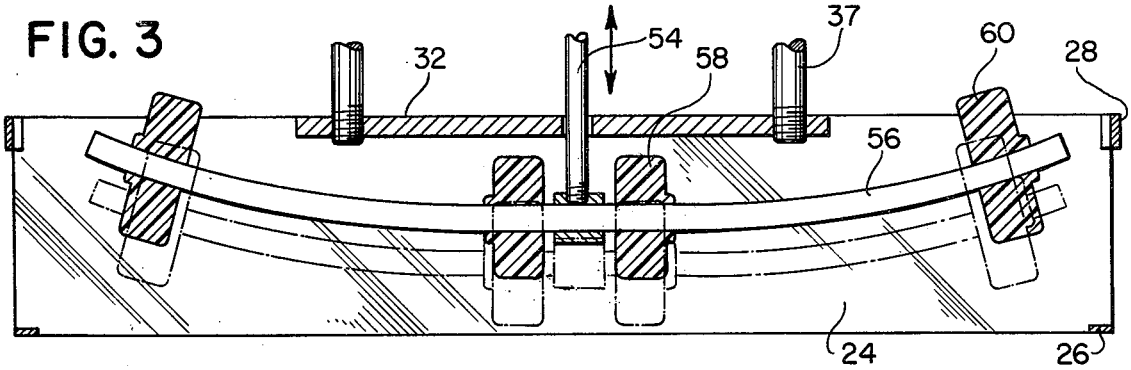
FIG. 4
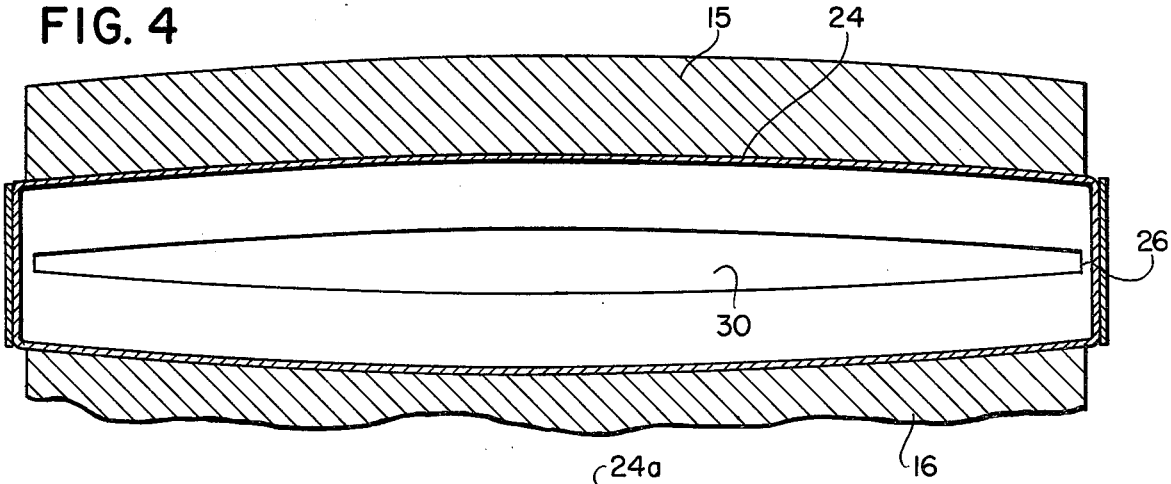
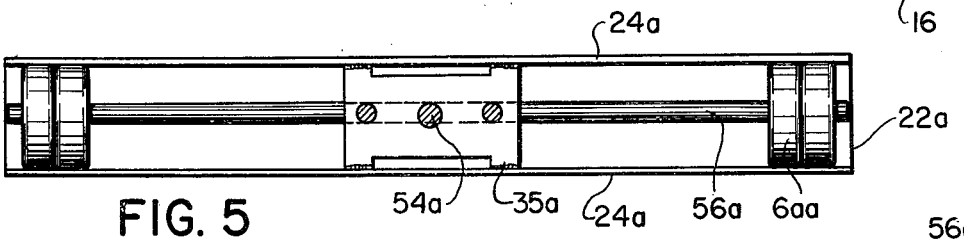
FIG. 5
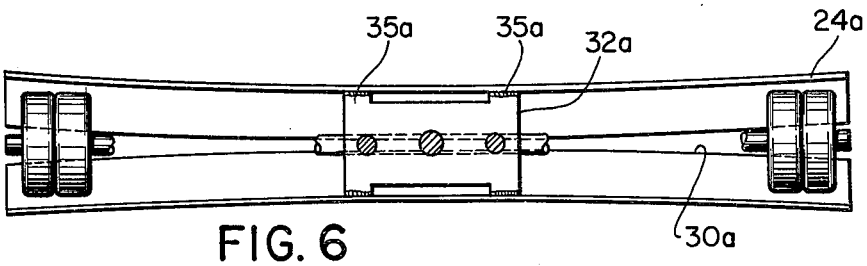
FIG. 6
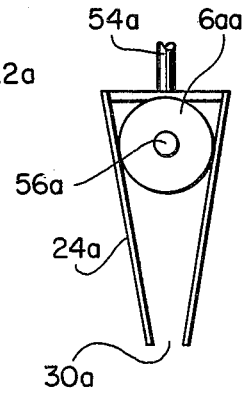
FIG. 7

APPARATUS FOR BENDING CONCRETE CURBING

BACKGROUND OF THE INVENTION

This invention relates to apparatus for bending and more particularly for initially or pre-bending pairs of concrete curbing as they emerge from an automatic casting machine and while still in a zero slump state. Pre-cast concrete curbing of this type is conventionally formed with one vertical side and the other side slanted, that is, being wider at the base and upwardly slanted to a narrow top. Curbing emerges from the machine in pairs, with the slanted sides facing and slightly separated from each other so as to form a substantially V-shaped space therebetween.

Thereafter the curbing pairs may be pre-bent by forcing an elongated device or tool having a generally V-shaped cross-sectional configuration and bowed convex sides, i.e. sides curving from end to end, into the V-shape space so as to force the curbs to be bent away from each other in opposite curves. The amount of bend can be controlled by the depth of insertion of the such device, the deeper the insertion, the greater the bend. After such pre-bending step, a second and final step is performed with an elongated, generally inverted U-shaped bending tool which is formed with the required bending radius and of an internal configuration to fit the pre-bent curbing. A different tool is provided for each desired radius. This second tool is then sequentially forced over each of the pre-bent curbings so as to complete their final curvature. The thus formed curved curbings are then kiln set.

The equipment and operational manner above referred to is described in greater detail in applicants' prior patent, U.S. Pat. No. 3,941,545 issued Mar. 2, 1976. In that regard the above citation and discussion constitutes applicants's prior art statement and a copy of that patent is included in the filing of the subject application. While the equipment therein described is satisfactorily suited for the indicated purpose, it has been found that upon withdrawing the pre-bending tool, its frictional contact with the pre-bent sides of the curbing pairs can upset and distort the surface thereof which can result in damaged curbing. Accordingly it would be desirable to eliminate such potential for damaged curbing.

SUMMARY OF THE INVENTION

It is accordingly a primary object of the present invention to provide apparatus wherein pairs of curbing may be desirably pre-bent by a forming tool inserted therebetween but which forming tool upon withdrawal does not unduly frictionally contact the curbing so as to eliminate the possibility of injuring the curbing shape or surface characteristics.

A further object of the present invention is the provision of a forming tool which may simultaneously pre-bend opposed pairs of concrete curbing sections in such a manner that the inclined surfaces thereof may be bent into either a concave or a convex configuration.

A still further object of the present invention is the provision of apparatus which can be placed in position, manipulated and withdrawn in a relatively short period of time such that the pairs of concrete curbing bent thereby may be finally shaped by a tool having the required bending radius while still in an unset state.

These and other objects of the present invention are accomplished by the provision of an elongated blade-like tool substantially of V-shaped cross-section configuration. The tool which is provided with opposed flexible sidewalls is adapted to contact the inclined sides of the curbing pair when the tool is inserted in the V-shaped space therebetween.

Means in the form of longitudinally spaced rollers mounted on a downwardly movable shaft are provided so as to outwardly flex such sidewalls when such means is progressively forced into interior portions of the tool. The outwardly flexed sidewalls in turn serve to simultaneously bend the curbing pair.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 2 is a plan view thereof partially in section taken along the line 2—2 of FIG. 1;

FIG. 3 is an elevational view thereof partially in section taken along the line 3—3 of FIG. 2;

FIG. 4 is a sectional plan view showing the device with parts removed for clarity disposed between a pair of concrete curbing after having pre-bent the same;

FIG. 5 is a plan view similar to FIG. 2 of the drawings but showing an alternate embodiment thereof;

FIG. 6 is a plan view similar to FIG. 5 but showing the tool in a flexed or pre-bending disposition; and FIG. 7 is an end view of FIG. 5.

DESCRIPTION OF THE INVENTION

Figure 1:
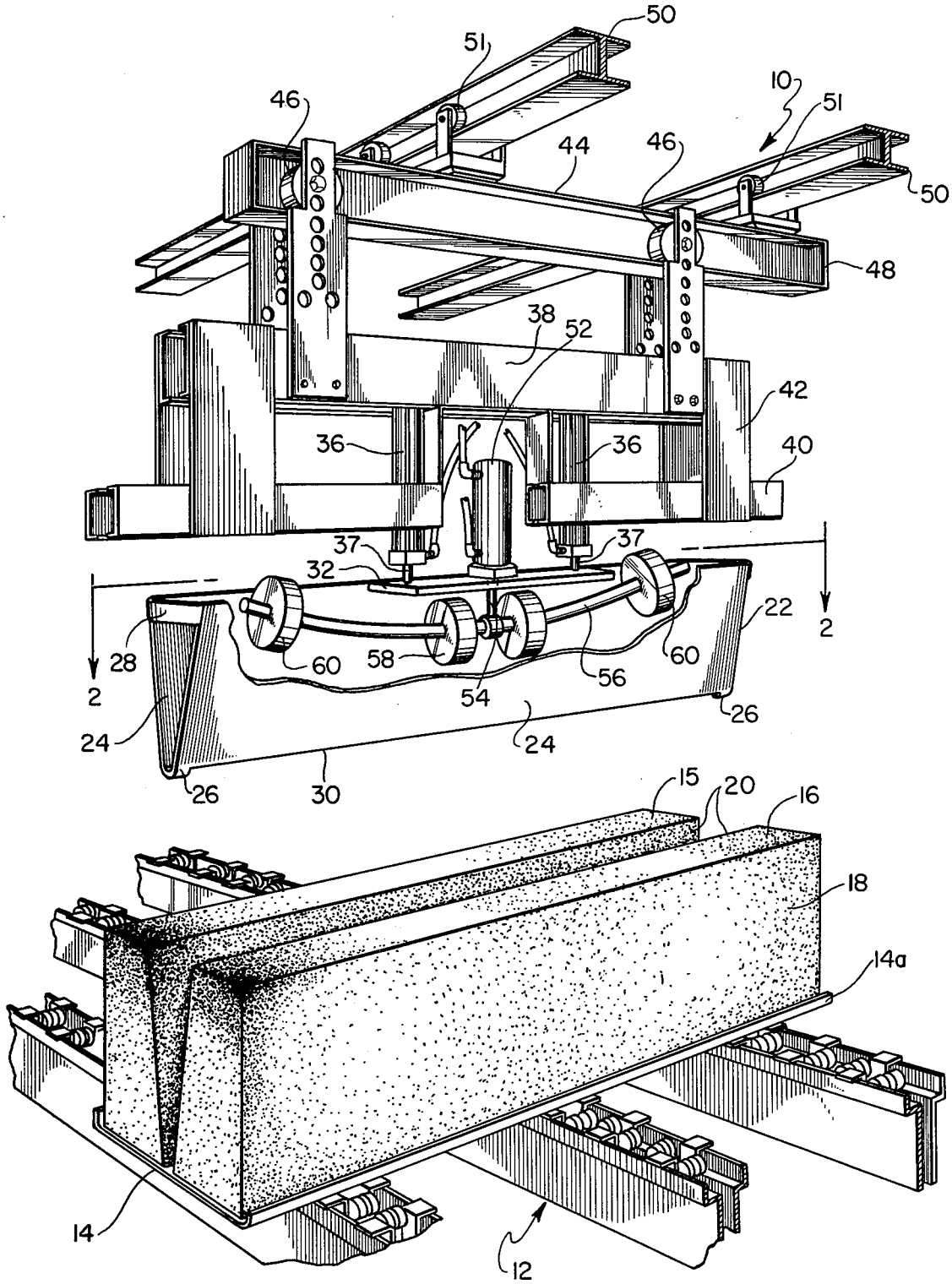
FIG. 1 is a perspective view of the pre-bending device of the present invention positioned over a pair of pre-cast concrete curbings, with portions broken away for purposes of illustration.

Turning now to FIG. 1 of the drawings, the pre-bending device 10 of the present invention is shown positioned above a pair of concrete curbing that may be formed by an automatic pre-casting machine (not shown) but which may be similar to that shown in U.S. Pat. No. 3,824,059 issued July 16, 1974. A conveyor 12 serves to support a flanged plate or pallet 14 upon which the pair of pre-cast curbings 15, 16 are disposed. The plate 12 forms the bottom of the mold of the machine so that the curbs are cast directly on it. Conventionally, at its base, each curb is 10 inches wide, spaced about an inch from each flange 14*a*, and spaced about an inch from each other in the center. The curbings are about eighteen inches in height with straight outer sides 18 and slanted inner sides 20 and are positioned with their slanted sides 20 in opposed relationship so as to form a substantially V-shaped space therebetween. Obviously the dimensions of the particular curbing pair 15, 16 may be varied so long as the same general relationship as above described is maintained. The curbing 15, 16 after emerging from the pre-casting machine is still moist and unset but in a zero slump condition which permits its handling without disturbing its configuration or dimensions. The bending operations of the present invention should therefore be performed generally within the first ten minutes after formation of the curbing and preferably within the first three minutes, since otherwise the curbs will commence to become too hard to permit effective bending.

The pre-bending apparatus of the present invention includes a tool 22 of generally longitudinally elongated configuration and having a pair of opposed, resilient sheet metal sidewalls 24. The sidewalls 24 are connected to each other at opposite ends thereof by means of a lower connecting web 26 and a pair of straps 28 at the upper edges thereof. The lower terminal portion of the tool 22 is characterized by an open slot 30 disposed between the connecting members 26 such that substantially the entire bottom extent of the tool 22 is open. Similarly, the portion at the upper space between the opposed sidewalls 24 is also open, although the central portion thereof includes a member 32 in turn having a central portion or plate 34 in spaced relation with the sidewalls 24. The member 32 is provided at either end thereof with tabs 35 which contact the sidewalls 24 and through which the member 32 is fixedly attached to the sidewalls, as by welding. The plate 34 serves as a platform or support by which the tool 22 may be raised and lowered with respect to the curbing pair 15, 16. Such action is accomplished by a pair of spaced hydraulic or pneumatic cylinders 36 having pistons 37 and in turn suitably supported from a pair of horizontally disposed spaced members 38 and 40. Such members are in turn interconnected by means of vertically extending plates 42 and the entire structure supported by a traveling assembly 44 including a pair of spaced wheels 46 adapted to travel within a beam 48, whereby the tool 22 may be shifted from side to side in order to be properly aligned with the curbs 15, 16. The beam 48 is in turn suitably mounted to a pair of I-beams 50 as by rollers 51 and in this manner the tool 22 may be moved along the beams 50 until the tool 22 is in registry with the V-shaped space between the curbs 15, 16.

The plate 34 also forms a support for a hydraulic or pneumatic cylinder 52 which operates a vertically orientated piston rod or shaft 54. The shaft 54 is connected to a horizontally or longitudinally disposed shaft 56 which has a pair of spaced hard rubber rollers 58 disposed centrally thereof beneath the plate 34 and a second pair of such rollers 60 disposed adjacent opposite ends thereof. The shaft is upwardly bowed at the ends such that the pair of rollers 60 do not extend into interior portions of the tool 22 between the opposed sidewalls 24 thereof to the same extent as do the central rollers 58. Thus, although each of the roller pairs 58, 60 contact opposite sidewalls 24 at different preselected portions along the longitudinal extent of the tool 22, when the shaft 54 is downwardly forced into the interior of the tool, the depth to which such rollers extend will be materially greater with respect to the central pair of rollers 58 than with respect to the end rollers 60. This enables the central portions of the sidewalls 24 to be forced apart, i.e., outwardly bowed to a considerable extent, as shown in FIG. 4, whereas the end portions thereof are bowed to a lesser extent or not at all. Thus when the rollers 58 and 60 are driven downwardly or inwardly of the tool 22, as shown in the dotted line configuration in FIG. 3 of the drawing, the sidewalls 24 will expand or outwardly flex so as to form the convex side-to-side configuration of the tool 22, as shown in FIG. 4. Although to some extent the fixed connection of the member 32 to the sidewalls 24, as by the ears 35, will serve to modulate the curvature, the widely spaced disposition of such attachment points 35 enables a significant central bowing sufficient to accomplish the simultaneous pre-bending of the concrete curbings 15 and 16. The sidewalls 24 may also to a degree be outwardly bulged in those areas beneath the platform as well.

In operation of the device, the tool, in its normal unflexed state, is positioned above the curbings 15 and 16 and thereafter lowered by means of the pistons 37 and cylinders 36 into the V-shaped space between the curbings. Thereafter it is expanded by operation of the cylinder 52 and rod 54 to curve the sidewalls 24 and preshape the curbings, as above indicated, and then the rollers 58, 60 are withdrawn to their normal upper position so that the sidewalls 24 may return to their normal state wherein the frictional contact between the sidewalls 24 and the inclined surfaces 20 of the curbing 15 and 16 will be reduced. Thus, when the tool is vertically withdrawn from the space between the curbs the likelihood of upsetting or marring the interior surfaces 20 is eliminated.

Turning now to FIGS. 5 through 7 of the drawings, an alternate constructional embodiment of the forming tool is shown and illustrated by reference numeral **22*a*. In such embodiment the sidewalls 24*a* are unconnected at the opposite ends thereof, that is, the slot 30*a* extends the entire lower extent thereof. The walls 24*a* are, however, joined at central locations by a platform 32*a* having connection points or tabs 35*a* more closely spaced and centrally disposed than in the embodiment shown in FIGS. 1 through 4. In other words, the tabs 35*a* are disposed closely together such that the sidewall space therebetween is materially reduced and accordingly prevents the sidewall portions disposed therebetween from outwardly bending. The means for outwardly forcing or separating the sidewalls 24*a* from each other in this embodiment includes a shaft 56*a* which eliminates the central pair of rollers and relies on a spaced pair of rollers 60*a* disposed at either end thereof. Also the shaft 56*a* is essentially straight, that is, there is no upward bend in this embodiment. When the vertical shaft 54*a* is activated by the cylinder 52, the downward movement of the rollers 60*a* within the interior portions of the tool 22*a* will force the opposite ends of the sidewalls 24*a* apart from each other and in this way an opposite bend will be placed within the inclined walls 20 of the curbing 15 and 16 from that imparted thereto by the tool 22 of the previously described embodiment. In other words, the tool configuration shown in FIGS. 1 through 4 will impart a concave curve configuration to the inclined walls 20 and a convex curve configuration to the straight walls 18, whereas the tool configuration described with regard to FIGS. 5 through 7 will do just the opposite, i.e., impart a convex curve to the inclined walls 20 and a concave curve to the straight walls 18**. Curbing having such different curves is required for various construction purposes, such as for the opposite sides of a curved highway.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for simultaneously bending pairs of unset pre-cast zero slump concrete curbing as they emerge in spaced parallel relation from an automatic casting machine, said curbing having inclined sides in facing relation whereby the space between each pair of curbing is substantially V-shaped, said apparatus comprising an elongated blade-like tool having a pair of opposed sidewalls defining a normally V-shaped cross sectional configuration and adapted for positioning between said pair of curbing while in such normal configuration with said opposed sidewalls contacting said inclined sides, said sidewalls being outwardly flexible, first means for forcing said tool between said pair of curbing and second means for forcing said flexible sidewalls apart from each other at a selected portion thereof along the longitudinal extent thereof so as to impart curvature to said sidewalls and simultaneously cause corresponding bending of said spaced curbing and thereafter enabling said sidewalls to return to their normal configuration so as to facilitate the removal of said tool from between said pair of curbing, said second means comprising a longitudinally orientated first shaft to which longitudinally spaced rollers are mounted, said rollers contacting said sidewalls at said selected locations thereof, and means for moving said shaft inwardly and outwardly of said tool so as to respectively force apart said sidewalls and permit them to return to said normal configuration.

2. The apparatus of claim 1, said sidewalls adapted to be centrally outwardly bowed, said sidewall opposite ends being interconnected.

3. The apparatus of claim 1, said sidewalls adapted for being outwardly forced apart at opposite ends thereof, said sidewalls being centrally interconnected with each other.

4. The apparatus of claim 1, said first means connected to said sidewalls for moving said tool into and out of said space between said pair of curbing.

5. The apparatus of claim 4, said first means including a plate fixedly connected to said sidewalls at upper portions thereof, said means for moving said longitudinally orientated first shaft including a vertically orientated second shaft connected to said first shaft and adapted to pass through said plate, said second shaft movable vertically with respect to said plate and said tool to force said first shaft and said rollers inwardly and outwardly of said tool.

6. The apparatus of claim 2, there being a first set of rollers centrally disposed on said first shaft and a second set of rollers disposed proximal the opposite ends thereof, said second roller set being upwardly offset from said first roller set such that said second roller set moves downwardly into said tool a lesser distance than said first roller set such that the opposite ends of said sidewalls bend to a lesser extent than does the central portion thereof.

7. The apparatus of claim 6, said longitudinally orientated first shaft being upwardly bowed at opposite ends thereof and centrally connected to a vertically orientated shaft forming a part of said second means.

8. The apparatus of claim 3, said rollers disposed at opposite ends of said tool only and adapted to extend inwardly between and in contact with end portions of said sidewalls so as to force said sidewall end portions apart from each other.

9. The apparatus of claim 5, there being a first set of rollers disposed beneath said plate and a second set of rollers disposed proximal the opposite ends of said tool and away from said plate, said second roller set being upwardly offset from said first roller set such that said second roller set moves downwardly into said tool a lesser distance than said first roller set such that the opposite ends of said sidewalls bend to a lesser extent than does the central portion thereof.

10. The apparatus of claim 9, said plate connected to said sidewalls at longitudinally separated points disposed to either side of the central portion of said tool wherein significant central portions of said sidewalls are free to outwardly flex between said plate attachment points.

* * * * *